US009080443B2

(12) United States Patent
Henderson et al.

(10) Patent No.: US 9,080,443 B2
(45) Date of Patent: Jul. 14, 2015

(54) METHOD AND APPARATUS FOR DOWNHOLE FLUID CONDITIONING

(71) Applicant: Premiere, Inc., New Iberia, LA (US)

(72) Inventors: Kris Henderson, Lafayette, LA (US); Lee Robichaux, Lafayette, LA (US)

( * ) Notice: Subject to any disclaimer, the term of this patent is extended or adjusted under 35 U.S.C. 154(b) by 236 days.

(21) Appl. No.: 13/660,034

(22) Filed: Oct. 25, 2012

(65) Prior Publication Data

US 2013/0105152 A1 May 2, 2013

Related U.S. Application Data

(60) Provisional application No. 61/551,485, filed on Oct. 26, 2011.

(51) Int. Cl.
*E21B 43/38* (2006.01)

(52) U.S. Cl.
CPC ..... *E21B 43/38* (2013.01)

(58) Field of Classification Search
CPC ..... E21B 43/38; E21B 43/34
USPC ..... 166/265
See application file for complete search history.

(56) References Cited

U.S. PATENT DOCUMENTS

| | | | | |
|---|---|---|---|---|
| 4,688,650 | A | 8/1987 | Hayatdavoudi et al. | |
| RE39,292 | E * | 9/2006 | Latos et al. | 166/265 |
| 7,938,203 | B1 | 5/2011 | Hall et al. | |
| 2009/0050374 | A1 | 2/2009 | Spiecker et al. | |

OTHER PUBLICATIONS

PCT International Search Report dated Dec. 31, 2012.

* cited by examiner

*Primary Examiner* — Brad Harcourt
(74) *Attorney, Agent, or Firm* — Ted M. Anthony

(57) ABSTRACT

A down hole fluid conditioning assembly, includable within a drilling bottom hole assembly or other tool configuration, creates a vortex to separate fluids such as drilling mud and the like into a lower density first portion and higher density second portion. The lower density first portion is directed toward the bottom hole assembly or other equipment to improve operational performance of the bottom hole assembly or other equipment. The higher-density second portion is directed away from the bottom hole assembly or other equipment, typically into a well annulus with an upward velocity component.

8 Claims, 5 Drawing Sheets

METHOD AND APPARATUS FOR DOWNHOLE FLUID CONDITIONING

CROSS REFERENCES TO RELATED APPLICATION

Priority of U.S. Provisional Patent Application Ser. No. 61/551,485, filed Oct. 26, 2011, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for treating and conditioning of drilling mud and other fluids. More particularly, the present invention comprises a method and apparatus for down hole conditioning of drilling mud and other fluids in a well.

2. Brief Description of the Prior Art

Drilling fluids (including, but not limited to, "drilling muds") are typically used in connection with drilling, completion, recompletion and/or working over of oil and gas wells. Such drilling fluids provide a number of benefits during such operations including, without limitation: (1) cooling and lubricating of a drill bit and/or other down hole equipment during drilling operations; (2) transportation of rock cuttings and other debris from the bottom of a well to the surface, as well as suspension of said rock cuttings and debris during periods when circulation is stopped; and (3) providing hydrostatic pressure to control encountered subsurface pressures. Drilling fluids often contain various additives or other components such as gelling agents (e.g. colloidal solids and/or emulsified liquids), weighing materials and chemicals necessary to control properties of such drilling fluids within desired limits.

Frequently, drilling fluids are pumped from the surface of a well, through a tubular drill string deployed in a well bore and having a drill bit or other equipment attached to the distal end of such tubular drill string. Such drilling fluids are pumped out of the drill bit or other down hole equipment, and then back to the surface of the earth via the annular space formed between the outside of the tubular drill string and the inside of the well bore. This pumping of drilling fluids down-hole and back to the surface is frequently referred to as "circulation."

The characteristics of such drilling fluids can have a significant impact on the overall quality and performance of the operations at issue. Further, the condition of such drilling fluids (including additives that are sometimes mixed with the fluids) can greatly impact the quality and efficiency of operations being performed. For example, the cutting efficiency of a rotary drill bit will frequently decrease as drilling fluid density is increased.

Accordingly, there is a need for a system for down hole conditioning of drilling fluids. The system should be compatible with existing down hole and surface equipment, and should treat and/or condition drilling fluids to generate improved performance of well operations including, without limitation, drilling operations.

SUMMARY OF THE INVENTION

The down hole fluid conditioning assembly of the present invention uses vortex flow to separate drilling fluids into a lower density first portion and higher density second portion. In the preferred embodiment, a lower density first portion of the drilling fluid stream is directed generally downward toward a drill bit or other equipment so that the drilling fluids adjacent to said bit have a density less than an initial density of the drilling fluids (that is, the density of the drilling fluids being pumped into the well from the surface). Such lower density fluid typically exhibits decreased viscosity, solids content, yield point, gel strength, sand content and fluid loss characteristics. The second, higher-density portion of the drilling fluid stream is directed into a well annulus with an upward component of velocity, thereby reducing the hydrostatic drilling fluid pressure immediately adjacent to the drill bit.

The method and apparatus of the present invention promotes increased drilling performance with conventional drilling equipment by generating a lower viscosity fluid that is directed toward the bottom hole assembly (including, without limitation, a drill bit) while producing a localized reduced specific weight in the vicinity of said bottom hole assembly. Such separated drilling fluids can be used to achieve higher rates of penetration with less expensive drilling and pumping equipment. Because the down hole fluid conditioning assembly of the present invention modifies the rheology of the drilling fluids in the vicinity of the drill bit, higher penetration rates are possible with less hydraulic horsepower and weight-on-bit requirements.

When used in connection with a mud motor, the present invention also improves both mud motor and bit life. The down hole fluid conditioning assembly of the present invention permits easy removal of abrasive solids from the mud system which, if allowed to re-circulate, would cause damage and premature failure of drilling equipment including, without limitation, a mud motor and bit.

The down hole fluid conditioning assembly of the present invention also reduces the need for fine particle separation equipment, which is typically located at the surface, by minimizing the grinding of drill cuttings. Such reduction in the grinding of drill cuttings enables drilling fluids to transfer larger-sized drill cuttings to the surface. Larger cuttings are easier and less costly to remove from the drilling mud system which, in turn, reduces equipment requirements and associated costs. The present invention also makes more reservoirs economically viable, because it allows drilling of wells in a less costly manner enabling smaller reservoirs to be economically viable.

Although the above discussion primarily addresses benefits associated with drilling efficiency, it is to be observed that the present invention also improves down hole performance of numerous other operations. Specifically, the method and apparatus of the present invention can be used to improve the performance of any operation aided by down-hole conditioning of fluid. By way of illustration, but not limitation, such operations include circulating, cleaning, reaming and hole-opening operations. The apparatus of the present invention is also fully scalable. The dimensions of the apparatus can be adjustable such that the apparatus can be used in smaller diameter.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
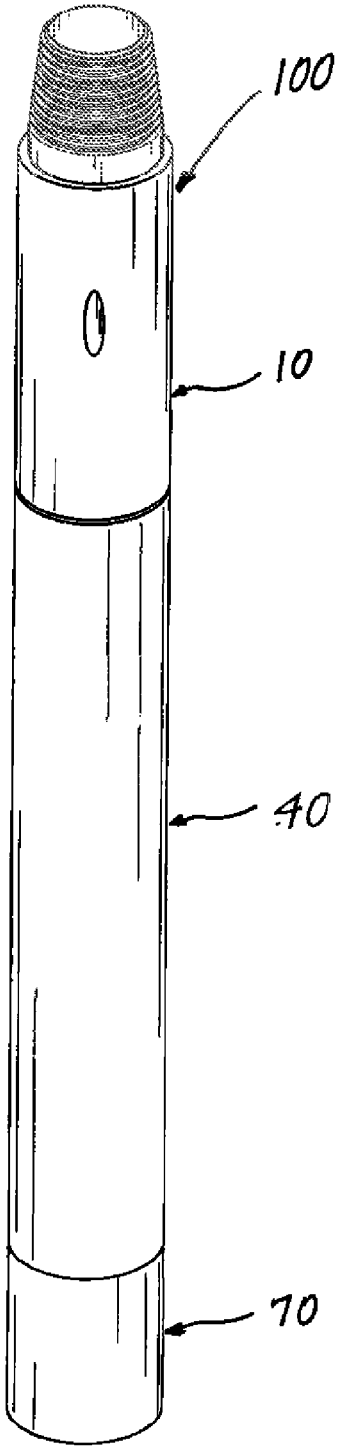
FIG. 1 depicts a side perspective view of the down hole fluid conditioning assembly of the present invention.

FIG. 1 depicts a side perspective view of down hole fluid conditioning assembly 100 of the present invention. In the preferred embodiment, said down hole fluid conditioning assembly of the present invention comprises a substantially tubular configuration that is compatible and connectable with other components of a conventional oil and gas bottom hole assembly or other tool string. In the embodiment depicted in FIG. 1, said down hole fluid conditioning assembly 100 further comprises joined upper cross over member 10, central body section 40 and lower connection member 70.

Figure 2:
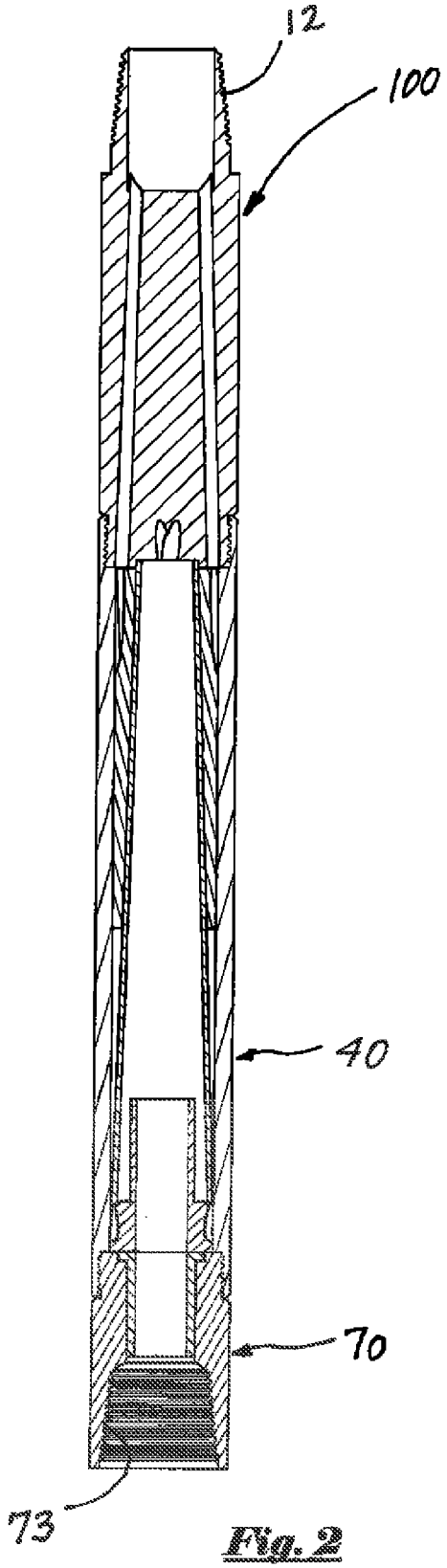
FIG. 2 depicts a sectional view of the down hole fluid conditioning assembly of the present invention.

FIG. 2 depicts a side sectional view of the down hole fluid conditioning assembly 100 of the present invention; as depicted in FIG. 2, said down hole fluid conditioning assembly 100 is rotated approximately ninety (90) degrees from the view depicted in FIG. 1. Although down hole conditioning assembly 100 is described in more detail below, it is to be observed that said down hole conditioning assembly 100 includes upper threads 12 and lower threads 73; upper threads 12 (typically a male "pin end" threaded connection) and lower threads 73 (typically a female "box end" threaded connection) can be used to interconnect down hole fluid conditioning assembly 100 to other threaded components of a bottom hole assembly or other tool string.

Figure 3:
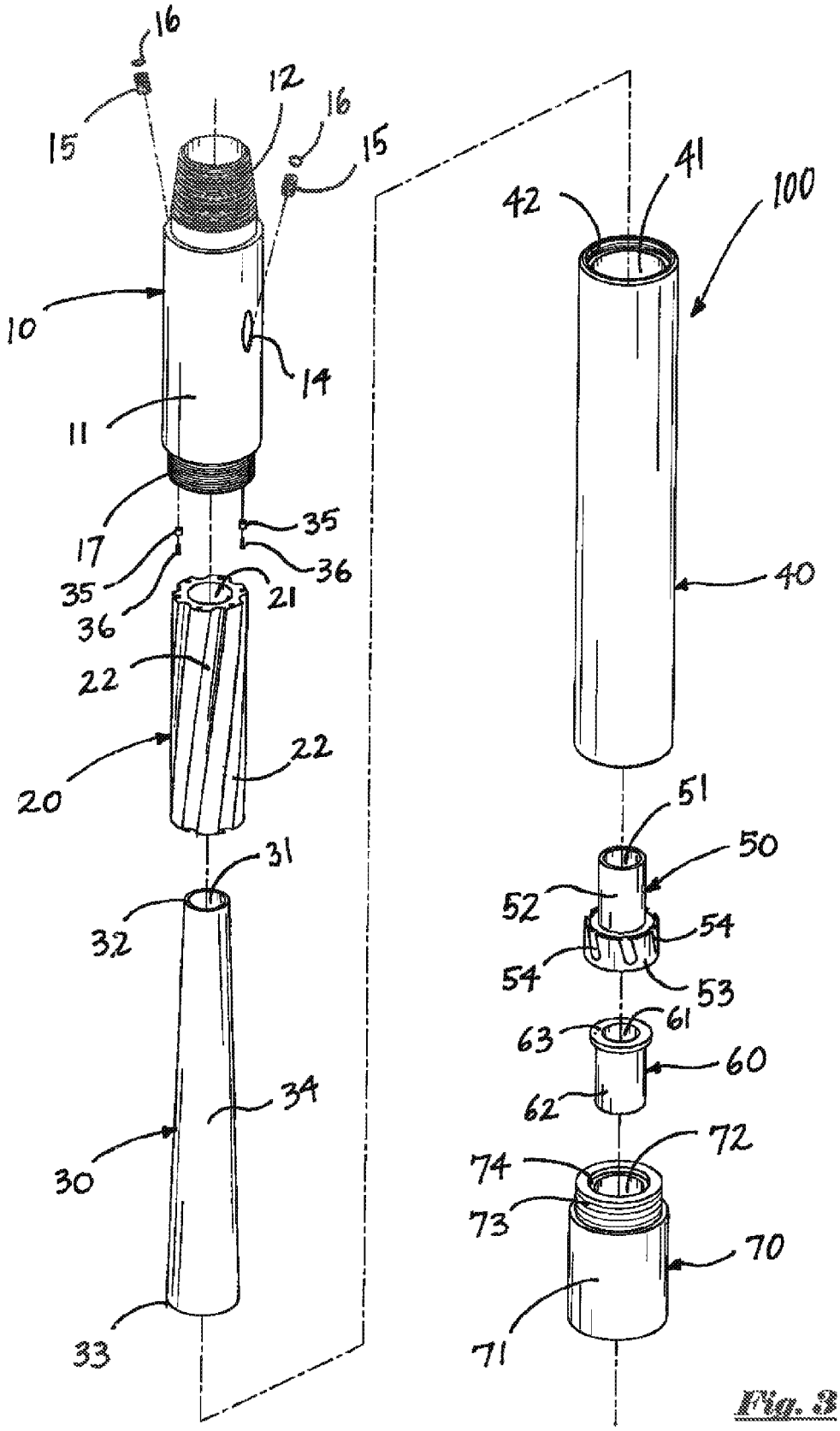
FIG. 3 depicts an exploded view of the down hole fluid conditioning assembly of the present invention.

FIG. 3 depicts an exploded view of the down hole fluid conditioning assembly 100 of the present invention. Upper cross over member 10 comprises body section 11 having upper threads 12 and lower threads 17. Side ports 14 are disposed on the outer surface of body section 11 of upper cross over member 10. In the preferred embodiment, said side ports 14 face in a substantially upward direction. A jet nozzle 15 is disposed within each upwardly facing side port, and is secured in place with snap ring 16.

As depicted in FIG. 3, vortex sleeve member 20 is substantially cylindrical and has a central through-bore 21 extending longitudinally through said vortex sleeve member 20. Vortex sleeve member 20 has a plurality of external flow channels or grooves 22 disposed on the external surface of said vortex sleeve member 20. In the preferred embodiment, said external flow channels 22 are oriented in a substantially helical or spiral pattern along the outer surface of said vortex sleeve member 20.

Figure 4:
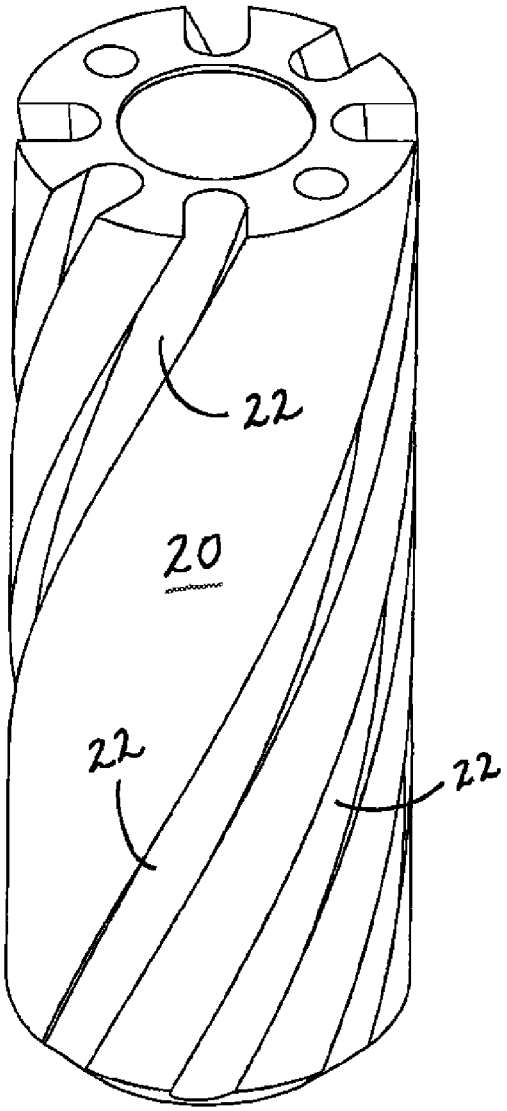
FIG. 4 depicts a top perspective view of a vortex sleeve member of the present invention.

FIG. 4 depicts a perspective view of a preferred embodiment of vortex sleeve member 20 of the present invention. Vortex sleeve member 20 has a substantially cylindrical outer shape, as well as a plurality of external flow channels or grooves 22 disposed on the external surface of said vortex sleeve member 20. In the preferred embodiment, said external flow channels 22 are oriented in a substantially helical or spiral pattern along the outer surface of said vortex sleeve member 20. It is to be observed that the dimensions and configuration of said external flow channels 22 (including, without limitation, the length, depth, width, directional orientation and/or slope) can be beneficially altered to adjust fluid flow through said flow channels and, ultimately, operational performance of the down hole fluid conditioning assembly of the present invention.

Figure 5:
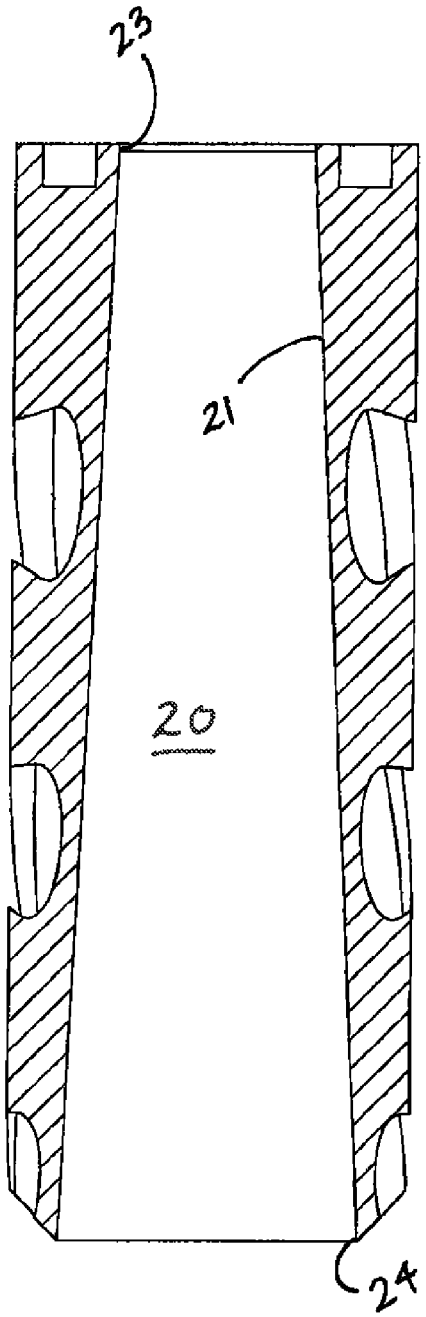
FIG. 5 depicts a side sectional view of a vortex sleeve member of the present invention.

FIG. 5 depicts a side sectional view of a preferred embodiment of vortex sleeve member 20 of the present invention. Central through-bore 21 extends longitudinally through said vortex sleeve member 20. Said central through-bore 21 is beneficially tapered, having a larger diameter near bottom opening 24 and a smaller diameter near upper opening 23

Referring back to FIG. 3, conical member 30 comprises body section 34 having central through-bore 31 extending longitudinally through said body section 34. Upper end 32 of conical member 30 (that is, the vertex of said conical member) has a smaller diameter than lower end 33 (that is, the base) of said conical member 30. Said conical member 30 is received within tapered central through bore 21 of vortex sleeve member 20. Put another way, said vortex sleeve member 20 is disposed on the outer surface of conical member 30. Said conical member 30 can be beneficially oriented and prevented from rotation using guide disk members 35 and fasteners 36.

Cylindrical body section 40 has central through bore 41 extending through said cylindrical body section 40. In the preferred embodiment, conical member 30 and vortex sleeve member 20 are received within said central through bore 41 of body section 40. Lower threads 17 of upper cross over member 10 join with mating upper threads 42 of body section 40, thereby permitting interconnection of said upper cross over member 10 with body section 40.

Internal stator member 50 has substantially cylindrical body member 52 and base section 53; base section 53 has a larger outer diameter than body member 52. Central through bore 51 extends though said internal stator member 50. External flow channels or grooves 54 are disposed on the external surface of base section 53 of internal stator member 50. In the preferred embodiment, said external flow channels 54 are oriented in a substantially helical spiral pattern said base section 53. Internal stator member 50 is received within the bottom of central through bore 41 of body section 40 (obscured from view in FIG. 3).

Figure 6:
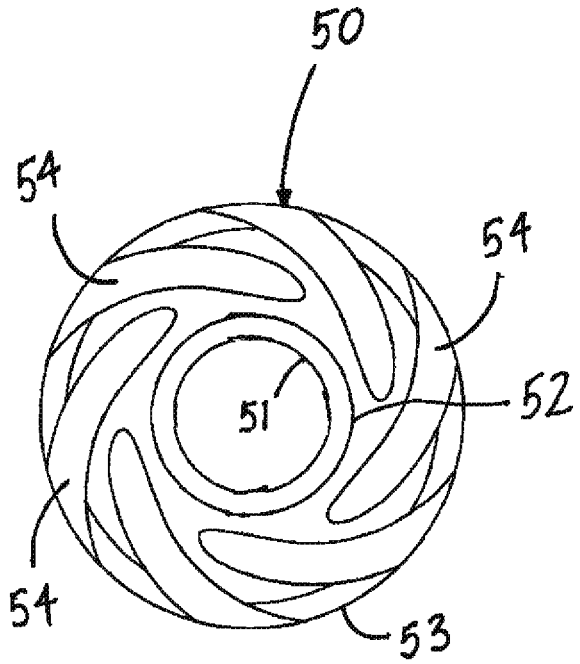
FIG. 6 depicts an overhead view of an internal stator member of the present invention.
Figure 7:
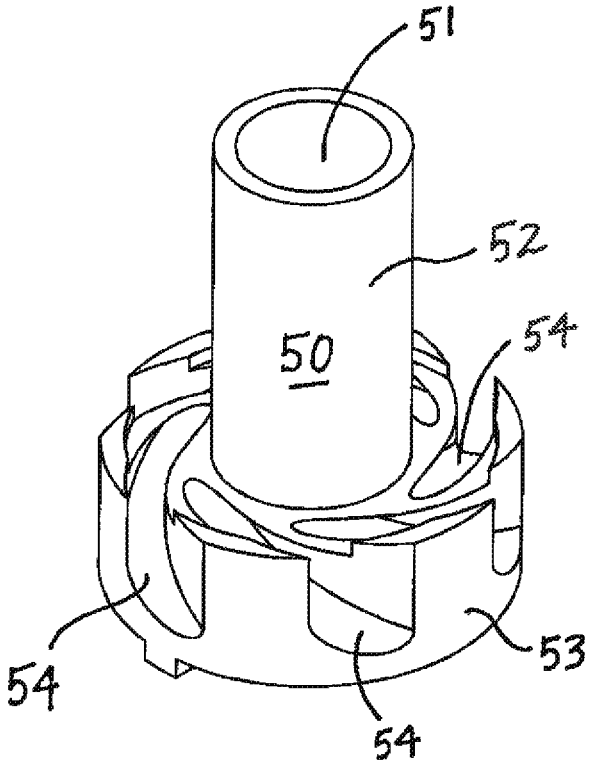
FIG. 7 depicts a perspective view of an internal stator member of the present invention.

FIG. 6 depicts an overhead view of a preferred embodiment of an internal stator member 50 of the present invention, while FIG. 7 depicts a perspective view of said internal stator member 50 depicted in FIG. 6. Stator member 50 has substantially cylindrical body member 52 and base section 53; base section 53 has a larger outer diameter than body member 52. Central through bore 51 extends though said internal stator member 50. External flow channels or grooves 54 are disposed on the external surface of base section 53 of internal stator member 50.

Referring to FIG. 7, external flow channels 54 are oriented in a substantially helical spiral pattern along said base section 53. It is to be observed that the dimensions and configuration of said external flow channels 54 (including, without limitation, the length, depth, width, directional orientation and/or slope) can be beneficially altered to adjust fluid flow through said flow channels and, ultimately, operational performance of the down hole fluid conditioning assembly of the present invention.

Referring back to FIG. 3, insert member 60 has cylindrical body member 62 having enlarged upper rim member 63. Central through bore 61 extends though said insert member 60. Lower connection member 70 has body section 71 and central through bore 72 extending through said lower connection member 70. Central through bore 72 is larger near its upper end, thereby defining an upwardly facing shoulder member 74 which provides an internal "ledge" extending substantially around said central through bore 72. Insert member 60 is received within central through bore 72 of lower connection member 70, with enlarged upper rim member 63 disposed on said internal shoulder member 74. Connection threads 73 of lower connection member 70 join with mating threads (not visible in FIG. 3) near the base of body section 40 to interconnect said lower connection member 70 with body section 40.

Figure 8:
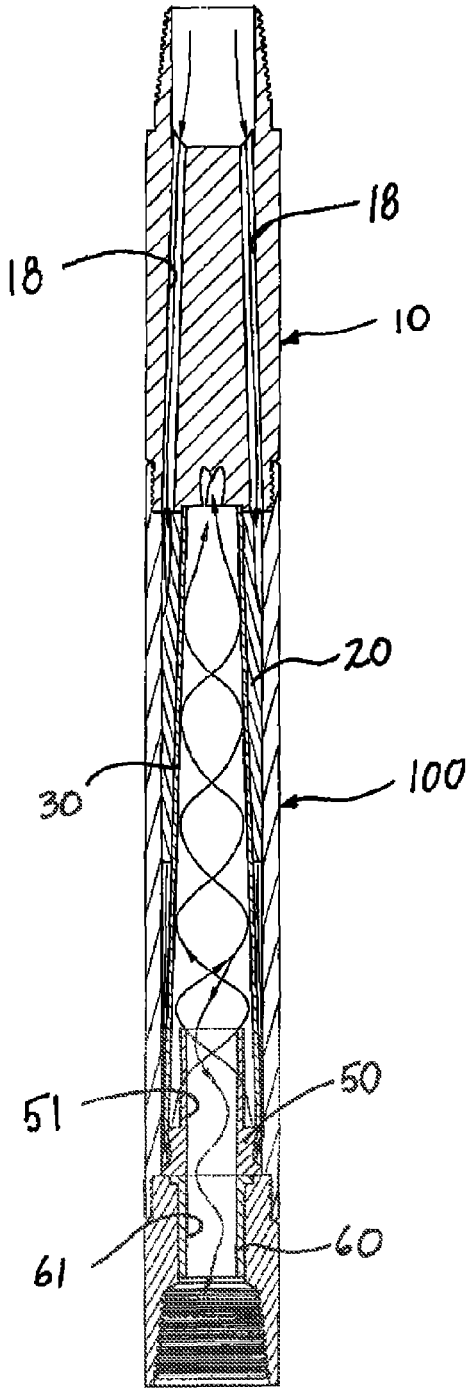
FIG. 8 depicts a first sectional view of the down hole fluid conditioning assembly of the present invention depicting fluid flow paths through said assembly.
Figure 9:
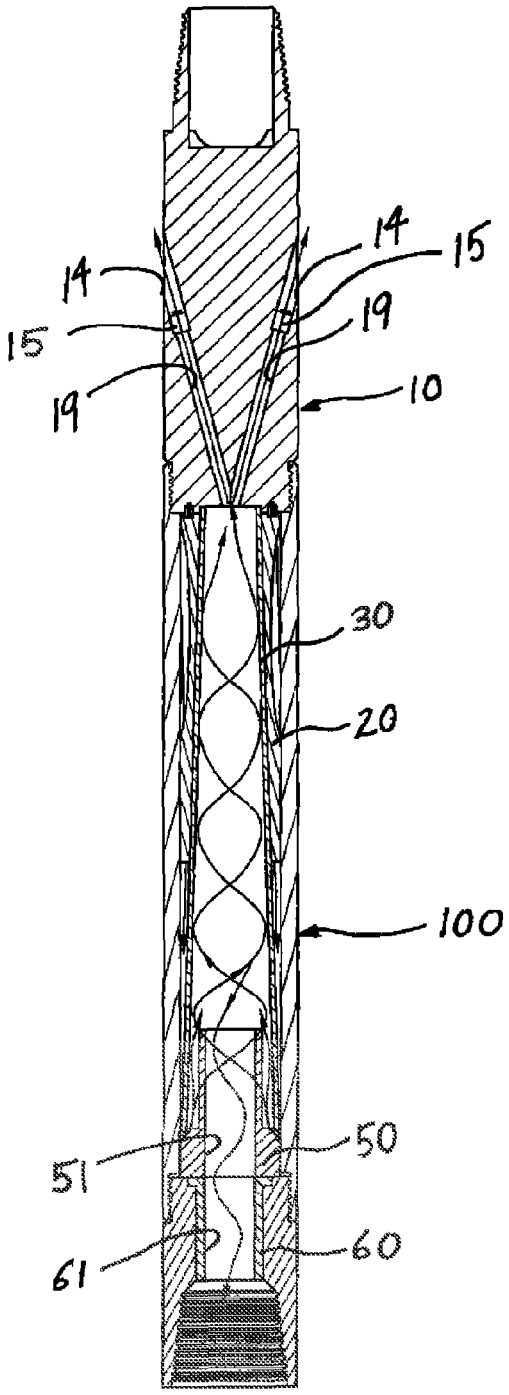
FIG. 9 depicts a second sectional view of the down hole fluid conditioning assembly of the present invention depicting fluid flow paths through said assembly, rotated ninety (90) degrees from view shown in FIG. 8.

FIG. 8 depicts a first side sectional view of the down hole fluid conditioning assembly 100 of the present invention with arrows depicting fluid flow paths through said assembly, while FIG. 9 depicts a sectional view of the down hole fluid conditioning assembly of the present invention with arrows depicting fluid flow paths through said assembly, rotated ninety (90) degrees from view shown in FIG. 8.

In operation, down hole fluid conditioning assembly 100 of the present invention is included at a desired location within a bottom hole assembly or other drill string (using upper threaded connection 12 and lower threaded connection 73) and conveyed into a well on drill pipe or other tubular workstring. By way of illustration, but not limitation, it is to be observed that down hole fluid conditioning assembly 100 can be positioned above or adjacent to a drill bit or down hole mud motor. Once said fluid conditioning assembly 100 is positioned at a desired location within said well via tubular workstring, drilling fluid is pumped into the wellbore from a rig or other surface equipment through the inner bore of said tubular workstring.

Referring to FIG. 8, drilling fluid flows through said tubular workstring, and enters down hole fluid conditioning assembly 100 through cross over member 10. Such drilling fluid passes through inlet flow channels 18 extending through said cross over member 10 and is directed around the outer surface of vortex sleeve member 20. More specifically, the fluid is directed through a plurality of helical external flow channels 22 disposed along the outer surface of said vortex sleeve member 20. Said helical external flow channels 22 provide a lateral directional element to fluid exiting said flow channels 22.

As the drilling fluid leaves said flow channels 22 on the external surface of said vortex sleeve member 20, such fluid is directed to inner stator member 50, itself having a plurality of helical external flow channels 54. Said helical external flow channels are not visible in FIGS. 8 and 9, and can best be observed in FIG. 7. As noted above, the dimensions and configuration of flow channels 22 and 54 (including, without limitation, the length, depth, width, directional orientation and/or slope) can be beneficially varied to adjust operational performance of the down hole fluid conditioning assembly of the present invention. Further, as depicted in the embodiment shown in FIG. 3, flow channels 22 and 54 can also be oriented in opposing directions from one another.

External flow channels 54 of said internal stator member 50 add directional rotational forces to fluid flowing through such channels. As such, fluid departing said external flow channels 54 creates a fluid vortex. Specifically, as such fluid is directed from said flow channels 54, said fluid vortex flows into the tapered internal chamber formed by central through bore 31 of conical member 30. As a result of said vortex flow, solids and fluid components having relatively higher density are directed generally radially outward toward the inner surface of bore 31 of conical member 30. Such solids and fluid components having relatively higher density travel upward through the tapered central through bore 31 of conical member 30 and, ultimately, into outlet flow channels 19 of upper cross over member 10 (see FIG. 9).

As depicted in FIG. 9, said flow channels 19 extend through upper cross over member 10 to upwardly-facing side ports 14 of said upper cross over member 10. A jet nozzle 15, disposed within each upwardly facing side port 14, directs such solids and more-dense fluids in an upward direction, allowing such solids and higher density fluids to flow in an upward direction into the annular space between the inner surface of the wellbore and the outer surface of the drill pipe or other tubular workstring.

Still referring to FIG. 9, lower density drilling fluid is separated from solids and relatively higher density fluid by the vortex flow within tapered bore 31 of conical member 30. Specifically, as solids and fluid components having relatively higher density are directed generally radially outward toward the inner surface of bore 31 of conical member 30 by such vortex flow, lower density fluid remains generally toward the center of bore 31 of conical member 30. Such lower density drilling fluid is directed out the central through bore 51 of the internal stator member 50 and, ultimately, through central through bore 61 of lower connection insert member 60.

In this manner, down hole fluid conditioning assembly 100 of the present invention performs down hole separation of drilling fluids (and other fluids) into a lower density first portion and higher density second portion. The lower density first portion of the fluid stream is directed downward, while the separated higher density second portion is directed upward.

The uses for the down hole fluid conditioning assembly of the present invention are many. However, in the preferred embodiment, such lower density fluids are directed to a drill bit or mud motor, so that the drilling fluids adjacent said bit have a density less than an initial density of the drilling fluid pumped into the well from the surface. Such lower density fluid can beneficially exhibit physical characteristics that will improve operational performance such as, for example, decreased viscosity, solids content, yield point, gel strength, sand content and fluid loss properties. The second, higher-density portion of the drilling fluid stream (together with any undesired solid or debris) is diverted away from said bit or bottom hole assembly, and is directed in the well annulus with an upward component of velocity, thereby reducing the hydrostatic drilling fluid pressure adjacent to the bottom hole assembly or drill bit.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for conditioning fluid in a well comprising:

a) pumping fluid into a down hole separator disposed within a well, wherein said down hole separator comprises:

i) a substantially cylindrical housing having a central through bore;

ii) a conical member having a vertex opening, a base opening, a central bore extending from said vertex to said base, and an outer surface, wherein said conical member is disposed within said substantially cylindrical housing and at least one helical flow channel is disposed on said outer surface of said conical member;

iii) a stator member having a central through bore and at least one helical flow channel along an external surface of said stator member, wherein said stator member is disposed near said base of said conical member; and iv) an outlet in fluid communication with said vertex opening of said conical member;

b) separating said fluid into first and second portions within said down hole separator, wherein said first fluid portion has lower density than said second fluid portion;

c) directing said separated first fluid portion downward from said separator apparatus; and d) directing said separated second fluid portion upward within said well.

2. The method of claim 1, wherein said at least one helical flow channel disposed on the other surface of said conical member is oriented opposite said at least one helical flow channel of said stator member.

3. A method for conditioning fluid in a well comprising:

a) positioning a down hole separator within a well, wherein said down hole separator comprises:

i) a substantially cylindrical housing having a central through bore;

ii) a conical member having a vertex opening, a base opening, a central bore extending from said vertex to said base and an external surface, wherein said conical member is disposed within said substantially cylindrical housing and at least one helical flow channel is disposed on said external surface of said conical member;

b) pumping fluid around the external surface of said conical member and into the base opening of said conical member;

c) generating a fluid vortex within said conical member; and d) separating said fluid into first and second portions within said conical member, wherein said first fluid portion has lower density than said second fluid portion.

4. An apparatus for down hole separation of fluid in a well comprising:

a) a substantially cylindrical housing having a central through bore;

b) a conical member having a vertex opening, a base opening, a central bore extending from said vertex to said base and an external surface, wherein said conical member is disposed within said substantially cylindrical housing;

c) a sleeve member having at least one helical flow channel received on said external surface of said conical member; and d) a stator member having a central through bore and at least one helical flow channel along an external surface of said stator member, wherein said stator member is disposed near said base of said conical member.

5. The apparatus of claim 4, further comprising a fluid cross over member comprising:

a) at least one fluid inlet;

b) at least one fluid outlet;

c) at least one flow path communicating said at least one fluid inlet to said at least one helical flow channel of said stator member; and d) at least one flow path communicating said vertex opening to said at least one fluid outlet.

6. The apparatus of claim 5, wherein said at least one fluid outlet opens into an annular space between said fluid cross over member and said well.

7. The apparatus of claim 6, wherein said at least one fluid outlet is oriented upward toward said annular space.

8. The apparatus of claim 5 further comprising at least one jet nozzle disposed within said at least one fluid outlet.

* * * * *